US006217746B1

(12) United States Patent
Thakkar et al.

(10) Patent No.: US 6,217,746 B1
(45) Date of Patent: Apr. 17, 2001

(54) TWO STAGE HYDROCRACKING PROCESS

(75) Inventors: Vasant P. Thakkar, Elk Grove Village; Daniel L. Ellig, Arlington Heights, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/375,208

(22) Filed: Aug. 16, 1999

(51) Int. Cl.[7] ..... C10G 65/00
(52) U.S. Cl. ..... 208/59; 208/58; 208/100
(58) Field of Search ..... 208/58, 59, 100

(56) References Cited

U.S. PATENT DOCUMENTS 4,197,184 4/1980 Munro et al. ..... 208/89
4,447,315 5/1984 Lamb et al. ..... 208/99
5,190,633 3/1993 Fetzer et al. ..... 208/99

OTHER PUBLICATIONS

Scherzer, Julius et al. "Hydrocracking Science and Technology", Marcel Dekker, Inc. (1996) pp. 174–183.

*Primary Examiner*—Helane Myers
(74) *Attorney, Agent, or Firm*—John G. Tolomei; John F. Spears, Jr.

(57) ABSTRACT

A two stage hydrocracking process is characterized by operation of the second hydrocracking zone at a reduced pressure, which is conducive to cracking the highly paraffinic effluent of the first hydrocracking zone. The process is also characterized by the passage of the partially compressed hydrogen makeup gas stream into the second hydrocracking zone followed by compressing the gas recovered from the second hydrocracking zone effluent to form the makeup gas to the first stage hydrocracking zone. There is no recycle gas stream for the second hydrocracking zone.

8 Claims, 1 Drawing Sheet

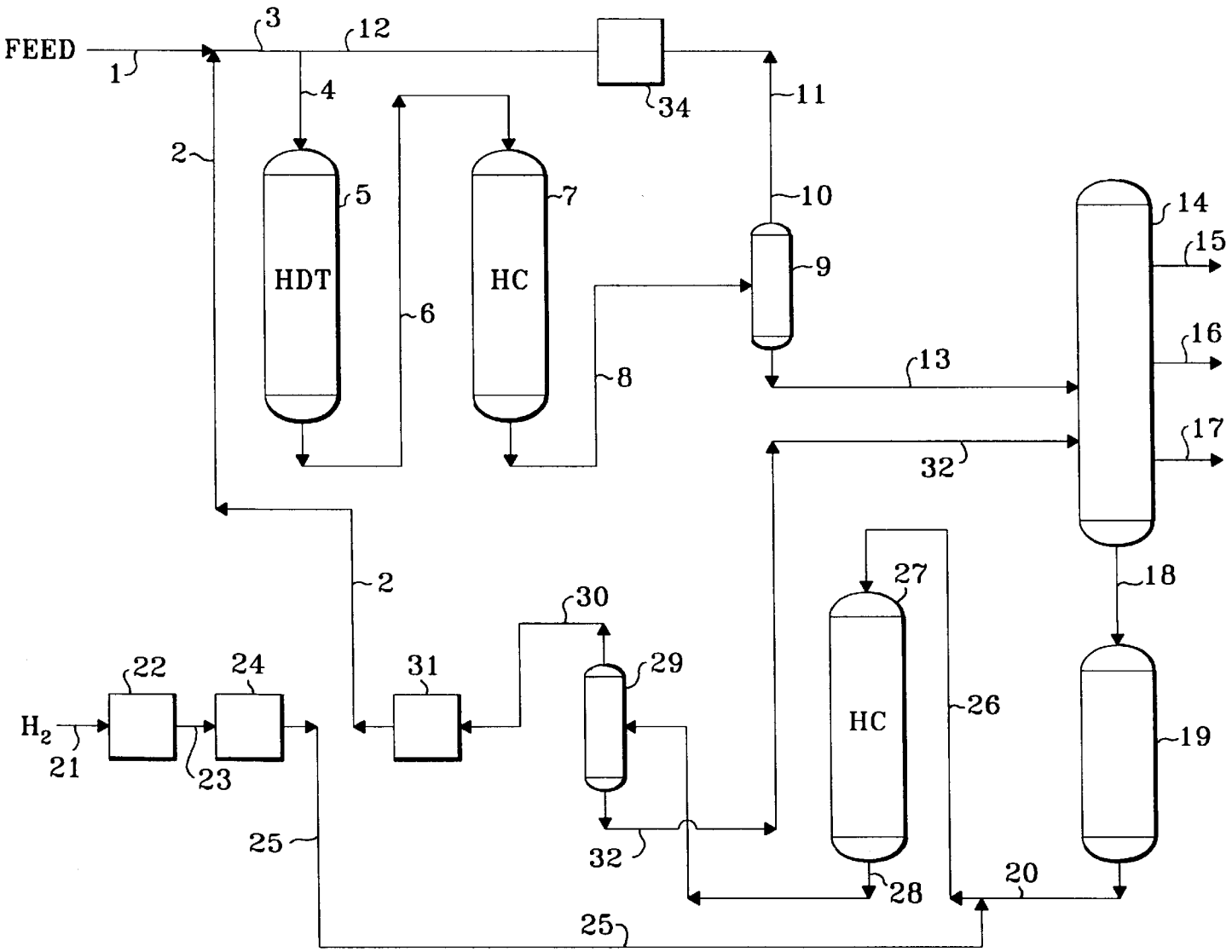
FEED
1
2
3
4
5
HDT
6
7
HC
8
9
10
11
12
13
14
15
16
17
18
19
20
21
$H_2$
22
23
24
25
26
27
HC
28
29
30
31
32
32
34

TWO STAGE HYDROCRACKING PROCESS

FIELD OF THE INVENTION

The invention relates to a hydrocarbon conversion process referred to in the art as hydrocracking. The process is used commercially in petroleum refineries to reduce the average molecular weight of heavy or middle fractions of crude oil. The invention more directly relates to an integrated hydrotreating/hydrocracking process which has a specific makeup hydrogen flowpath.

BACKGROUND OF THE INVENTION

Large quantities of petroleum-derived hydrocarbons are converted into higher value hydrocarbon fractions used as motor fuel by a refining process referred to as hydrocracking. In this process the heavy feed is contacted with a fixed bed of a solid catalyst in the presence of hydrogen at conditions of high temperature and pressure which result in a substantial portion of the feed molecules being broken down into molecules of smaller size and greater volatility. The high economic value of petroleum fuels has led to extensive development of both hydrocracking catalysts and the related process technology.

Raw petroleum fractions contain significant amounts of organic sulfur and nitrogen. The sulfur and nitrogen must be removed to meet modern fuel specifications. Removal or reduction of the sulfur and nitrogen is also beneficial to the operation of a hydrocracking reactor. The sulfur and nitrogen is removed by a process referred to as hydrotreating in which the organic sulfur and nitrogen is converted to hydrogen/sulfide and ammonia. Due to the similarity of the process conditions employed in hydrotreating and hydrocracking the two processes are often integrated into a single overall process unit having separate sequential reactors dedicated to the two reactions and a common product recovery section.

RELATED ART

Both hydrotreating and hydrocracking are widely practiced commercial processes. The very significant economic utility of the hydrocracking process has resulted in a large effort devoted to the improvement of the process and to the development of better catalysts for use in the process. A general review and classification of different hydrocracking process flow schemes and a description of hydrocracking catalysts is provided at pages 174–183 of the book entitled, *Hydrocracking Science and Technology* authored by Julius Scherzer and A. J. Gruia published in 1996 by Marcel Dekker, Inc. FIGS. 10.2, 10.3 and 10.4 show hydrotreating reactors upstream of the hydrocracking reactor. As noted therein it is an established practice to first pass a hydrocracking unit feed stream into a hydrotreating reactor in order to reduce the level of sulfur and nitrogen tied up in the target petroleum molecules. Two hydrocracking reaction zones may be used in series with some form of intermediate separation between the hydrocracking zones to reduce the amount of hydrogen sulfide and product hydrocarbons carried over to the second hydrocracking zone with the hydrocarbon phase. This type of unit is normally referred to a two stage hydrocracking unit as shown by FIGS. 10.4 and 10.5.

The high pressures employed in hydrocracking have prompted efforts to conserve the pressure of any portion of the hydrocracking effluent which is to be recycled and to also employ reductions in pressure as a separation mechanism in the product recovery section of the process. The effluent of a high pressure reactor such as a hydrocracking reactor therefore typically flows into a vessel referred to as a high pressure separator (HPS), which operates at a pressure close to the outlet pressure of the reaction zone. The vapor stream recovered from the HPS is often the recycle gas or the precursor of the hydrogen-rich gas stream recycled to the reactors.

The normal practice in hydrocracking processes is to employ a multistage compressor or bank of compressors to pressurize the makeup hydrogen stream and another compressor to pressurize the recycle gas stream. This use of two different compressors is shown for instance in U.S. Pat. No. 4,197,184.

The art also includes the adsorptive treatment of liquid-phase hydrocarbon recycle streams in a hydrocracking process to remove polynuclear aromatic (PNA) compounds as shown by U.S. Pat. Nos. 4,447,315 and 5,190,633.

SUMMARY OF THE INVENTION

The invention is a two stage hydrocracking process characterized in part by a novel hydrogen flow. The entire makeup hydrogen stream enters the process via the second stage hydrocracking reactor, which is operated at a low enough pressure to employ gas from the second stage of a three stage makeup gas compressor. The vapor recovered from the second stage reactor is fed into the third stage of the compression zone. The low pressure in the second stage hydrocracking reaction zone has been found to aid cracking paraffinic hydrocarbons not cracked in the first stage hydrocracking reactor. Thus the preferred second stage operating conditions interact synergistically with the process flow.

A broad embodiment of the invention may be characterized as a two stage hydrocracking process, which process comprises passing hydrogen and a feed stream comprising hydrocarbons having boiling points above 700° F. into a first hydrocracking zone operated at hydrocracking conditions including a first pressure and containing a hydrocracking catalyst and producing a first hydrocracking zone effluent stream comprising hydrogen, hydrogen sulfide, unconverted feed components and product hydrocarbons; separating the first hydrocracking zone effluent to yield a recycle gas stream and a first liquid process stream, which liquid process stream is passed into a product fractionation zone producing a distillate product stream and a bottoms stream comprising unconverted feed components; passing the bottoms stream and a makeup hydrogen gas stream into a second hydrocracking zone operated at paraffin selective hydrocracking conditions which include a lower second pressure, and producing a second hydrocracking zone effluent stream; separating the second hydrocracking zone effluent stream into a vapor phase stream and a liquid phase stream and passing the liquid phase stream into the product fractionation zone; and compressing the vapor phase stream and passing the vapor phase stream into the hydrotreating reaction zone as a makeup gas stream. In this embodiment the first hydrocracking zone may contain hydrotreating catalyst as a separate bed or reactor and is preferably operated at a pressure at least 300 psi above the pressure in the second hydrocracking zone.

BRIEF DESCRIPTION OF THE DRAWING

The drawing is a simplified process flow diagram showing makeup hydrogen entering a second stage hydrocracking reactor 27, with the vapor from the effluent of this reactor flowing into the third stage 31 of the makeup gas compressor employed in the process.

DETAILED DESCRIPTION AND PREFERRED EMBODIMENTS

Much of the crude petroleum which is produced cannot be used directly as a modern fuel or petrochemical feedstock. It must be refined to remove sulfur and nitrogen which would increase air pollution if present in a fuel. It must also be refined to reduce the average molecular weight of the heavier components of the crude such that the volatility or flow characteristics of fuels are met. Finally, refining is necessary to meet quality standards for specific hydrocarbon products.

The required refining can be done in several ways. One of the more established methods employs sequential catalytic hydrotreating and catalytic hydrocracking. This is a well-developed process used in a large number of petroleum refineries. The subject invention relates to modifications in the flow scheme of a two stage hydrocracking unit intended to reduce the cost of the unit and potentially improve its distillate products.

A wide variety of petroleum derived feed materials can be charged to the process. Typical feedstocks include virtually any heavy mineral or synthetic oil fraction having boiling points above about 400° F. (204° C.). Thus, such feedstocks as straight run gas oils, vacuum gas oils, demetallized oils, coker distillates, cat cracker distillates, and the like are contemplated. The preferred feedstock should not contain appreciable asphaltenes. The hydrocracking feedstock may contain nitrogen, usually present as organonitrogen compounds in amounts between 1 ppm and 1.0 wt. %. The feed will normally also contain sulfur-containing compounds sufficient to provide a sulfur content greater than 0.15 wt. %. It may also contain mono- and/or polynuclear aromatic compounds in amounts of 35 volume percent or higher. The compounds in the feed to the hydrotreating zone may have boiling points within the broad range extending from about 400° F. (204° C.) to about 1100° F. (593° C.) and preferably within the range of from about 600° F. (316° C.) to about 1022° F. (550° C.).

In a representative example of a conventional hydrocracking process, a heavy gas oil is charged to the process and admixed with a hydrocarbon recycle stream. The resultant admixture of these two liquid phase streams is heated in an indirect heat exchange means and then combined with a hydrogen-rich gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point. There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions. The reaction zone effluent will also contain the desired product hydrocarbons boiling in the gasoline, diesel fuel, kerosene and/or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone for heat recovery and then passed into a vapor-liquid separation zone normally including at least one high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention.

In many instances the overall conversion achieved in the hydrocracking reactor(s) is not complete and some heavy hydrocarbons are removed from the product recovery zone as a "drag stream" removed from the product fractionator. Removal of a drag stream from the hydrocracking process allows the use of less severe conditions in the reaction zone(s). The size of the drag stream can be in the broad range of 1–20 volume percent of the process feed stream, but is preferably in the range of 2–10 volume percent. Unconverted hydrocarbons may be recycled to either the first or second stage, with recycle to the second stage being preferred. The recycle stream may be passed into the first stage hydrotreating reactor if the overall process includes a hydrotreating reactor. It may also be passed directly into a first stage hydrocracking reactor.

Over the years great advances have been made in both hydrotreating and hydrocracking catalysts and process technology. Nevertheless the selectivity of commercial hydrocracking processes in converting feeds to hydrocarbons having boiling points in selected boiling point ranges is far from perfect. Compromises between operating variables are required in order to optimize the process, and improvement in selectivity remains an industry-wide goal. It is an objective of the subject process to provide a selective hydrocracking process for processing relatively light feeds which require only limited cracking for conversion to the desired products. It is a specific objective of the invention to provide a selective hydrocracking process for use with feed streams that contain a significant amount of hydrocarbons which already boil in the desired product boiling point range.

In the subject process the feed stream is preferably first subjected to a hydrotreating step. This has traditionally been practiced as a means of removing sulfur and nitrogen from the feedstock in order to prepare it for the downstream hydrocracking reactors. One reason for this is that a lower sulfur or nitrogen content tends to increase the observed activity of the hydrocracking catalyst. Hydrotreating, however, is optional. For instance, the use of an amorphous (non-zeolitic) hydrocracking catalyst in the first stage will normally render hydrotreating unnecessary. As shown in the references hydrotreating is often integrated with the first hydrocracking stage. This may be by means of placing separate hydrocracking reactor immediately in front of the first hydrocracking reactor or by actually loading hydrotreating catalyst upstream of hydrocracking catalyst.

Hydrotreating is a feed quality improvement step rather than a conversion or cracking step. The effluent from the hydrotreating reactor will preferably comprise an admixture of hydrocarbons having essentially the same boiling point range as the feed which enters the hydrotreating zone. Only a small amount, preferably less than 10%, conversion by cracking occurs during hydrotreating. Most preferably less than 5% conversion occurs in the hydrotreating zone. The conversion which does occur will produce some lower boiling hydrocarbons but the majority of the feed preferably passes through the hydrotreating zone with only a minor boiling point change. Therefore it is the effluent of the downstream hydrocracking zone which is fractionated to yield the final product distillate streams. Conversion is normally undesired in a hydrotreating step as it reduces the yield of the intended middle distillate products. The term "conversion" as used herein refers to the chemical change necessary to convert feed stream molecules into product hydrocarbons which become part of a distillate product recovered from the effluent of the respective reaction zone. Conversion therefore relates to a change in boiling point rather than chemical changes related primarily to hydrogenation or desulfurization.

The HPS vessel may contain some limited aids to separation or such as a tray or structured packing to promote better separation than provided by a simple one-stage flash separation. However, the high pressure in this vessel requires thick vessel walls and conduits which greatly increases the cost of the equipment to a degree that a larger high pressure separation device such as a column is prohibitively expensive. There is no reflux or reboiling of the HPS. Thus the separation in the high pressure separator will be inexact and there will be considerable overlap in the compositions of the fractions removed from a HPS.

In the normal parlance of the hydrocracking art a high pressure separator is a separator which is operated at close to the pressure of the upstream reactor. Some pressure reduction such as that inherent in fluid transfer through process lines and control valves will occur, but a HPS will normally be operated at a pressure within 150 psi of the upstream reactor. This preference to not reduce the pressure in the HPS is in order to avoid the very significant costs of recompressing the hydrogen-rich gas which is recycled to the reaction zones.

Hydrocracking processes are typically the highest pressure processes in a petroleum refinery. It is therefore unlikely that makeup hydrogen, which replaces the hydrogen consumed in reactions and lost in effluents, will be available for supply to the process at a pressure near that of the hydrocracking unit. It is therefor necessary to increase the pressure of the feed or makeup hydrogen. Typically this is done in a dedicated compressor referred to as the makeup compressor. A separate recycle compressor is used to circulate the gas stream flowing through the process. It is a fundamental practice to employ multiple stages compression in the equipment which comprises the makeup compressor. This is because of the much higher energy input required to perform a compression of this nature, e.g., from 100 psi to 2500 psi, in single step.

The drawing is a simplified process flow diagram which does not show customary equipment required for performance of the process such as valves, pumps, and control systems. Referring now to the drawing, the feed stream enters the process via line 1 and is admixed with a hydrogen-rich makeup gas stream passing through line 2. As used herein the term "rich" is intended to indicate the molar concentration of the indicated chemical or class of compounds is greater than 50 percent and preferably greater than 70 percent. The admixture of makeup hydrogen and the feed stream is then admixed with the recycle gas stream of line 12. The feed steam will be heated by a means not shown if necessary. The feed and hydrogen are passed into the hydrotreating reaction zone represented by the reactor 5 via line 4. The reactions which occur in this zone result in the formation of hydrogen sulfide and ammonia, and some light hydrocarbons by undesired side reactions but only minor cracking of the heavier hydrocarbons which enter the reactor. There is thereby formed a mixed phase hydrotreating reaction zone effluent stream which is passed through line 6 into a first hydrocracking zone represented by the reactor 7. This reactor is operated at conditions which effect a considerable conversion of the entering feed compounds into lower molecular weight compounds. These conditions will normally include a pressure above about 1800 psig, but which may be as low as 1500 psig. Pressures from 2000–2500 psig are often used. This produces a mixed phase first hydrocracking zone effluent stream comprising gases such as hydrogen and hydrogen sulfide, reaction products and liquid phase unconverted feed hydrocarbons.

The first hydrocracking reaction zone effluent stream is passed through line 8 into a high pressure separator (HPS) 9. This vessel is designed and operated to separate the entering mixed phase mixture into a vapor phase stream removed in line 10 and a liquid phase stream removed in line 13. The vapor phase stream is then passed into line 10 as the recycle gas stream. As the recycle gas is recovered at a reduced pressure due to the pressure drop in the two reactors and conduits it must be compressed back to the desired inlet pressure by means of the recycle compressor 34. The liquid phase stream will contain the vast majority of the product distillate boiling range hydrocarbons and unconverted feed hydrocarbons. These materials are passed via line 13 into the product recovery and separation zone represented by the single fractional distillation column 14. Normally one or more additional vapor liquid separations will be performed between the HPS 9 and the column 14 to separate out much of the light hydrocarbons such methane and propane produced as byproducts.

It is normally undesirable to pass significant quantities of these light compounds into the distillate-producing column. The liquid removed from the HPS 9 may therefore flow into the column via a conventional hot flash separator or cold high pressure separator or both not shown on the drawing. These separators, the stripping column which normally precedes the product recovery column and the product recovery column itself all drive volatile materials such as hydrogen sulfide in the withdrawn vapor phases. This leaves the recovered distillate products and unconverted compounds essentially free of hydrogen sulfide and, depending on the effectiveness of upstream hydrotreating, of organic sulfur as well. Low sulfur and nitrogen levels normally aid hydrocracking catalyst activity in the second stage.

The compounds passed into the product fractionation zone are separated into one or more distillate product streams depending on a number of refinery specific factors. Two columns can be used to perform this separation with a light ends stripping column often preceding the main product fractionation column. The distillate products may include a naphtha boiling range product of line 15, a kerosene boiling range product of line 16 and a diesel boiling range product of line 17. Hydrocracking zones are seldom operated to perform 100 percent conversion of the feed to products. Instead some percentage ranging from about 5 to 40 volume percent of the feed may be removed from the process as "unconverted" or "drag" material. While classified as unconverted, this material has been subjected to considerable hydrogenation and desulfurization and therefore is normally of higher quality than the corresponding feed compounds. The cracking which occurs in the process will also change the relative composition of these heavy materials such that the harder to crack or more refractory compounds will be present at a higher concentration than in the feed. As used herein the term unconverted is intended to indicate compounds removed from the product fractionation zone as part of a stream having a boiling points above that desired in any of the product distillate streams.

A stream comprising the unconverted hydrocarbonaceous material is removed from the column 14 via line 18. This material will have a higher concentration of paraffinic hydrocarbons than the feed stream. A portion of the unconverted material may optionally be withdrawn from the process as a drag stream if desired. The unconverted material of line 18 is preferably passed into an adsorption zone 19 designed and operated to selectively adsorb polynuclear aromatics (PNAs). Process technology for treating recycle streams in hydrocracking processes has been employed commercially and is described in such references as U.S. Pat. Nos. 4,447,315; 4,618,412; 4,954,242 and 5,190,633. This removal of the PNA's can be beneficial in preventing them from depositing in cold portions of the process such as heat exchangers and reduce heat exchanger efficiency. Deposits of PNA's in these locations can induce an excessive pressure drop in the process lines and exchangers and reduce heat exchange efficiency. In the subject process the main objective in removing the PNA's is to promote stable operation of the downstream hydrocracking zone. The activity and useful life of the catalyst in this zone may be decreased by a larger than normal extent by PNA accumulation due to operation at the preferred low hydrogen pressure. This PNA removal zone can be operated at the conditions of the stream removed from the bottom of the column 14. A number of adsorbents including aluminas are known, with the use of activated carbon being preferred. The contacting will preferably produce a treated stream of unconverted hydrocarbons having a lower PNA content as determined by methods set out in the cited references.

The treated hydrocarbon stream is removed from the PNA adsorption zone 19 via line 20 and admixed with a hydrogen-rich gas stream carried by line 25. In the subject process this gas stream is the makeup gas stream for the entire process and is preferably withdrawn from the second stage 24 of a three stage compression train. The makeup gas stream should normally have a sufficient flow rate to satisfy the desired hydrogen concentration in the downstream second hydrocracking zone. If the feed stream requires only nominal hydrotreating or for some other reasons the hydrogen demand in the process is low, then the makeup gas stream of line 25 can be augmented with recycle gas. However, it is preferred that no recycle gas is charged to the second hydrocracking zone. It is also preferred that all of the gas recovered from the second hydrocracking zone effluent is compressed and charged to the first hydrocracking zone. It is further preferred that the gas separation is performed using only the single HPS as illustrated.

The mixed phase stream of unconverted hydrocarbons and hydrogen is then heated if necessary and passed via line 26 into the second hydrocracking zone represented by the single reactor 27. This reactor contains a bed of hydrocracking catalyst operated at paraffin selective cracking conditions, which are primarily distinguished from the conditions in the first stage by a relatively low pressure for hydrocracking. The preferred operating pressure for this zone is therefor in the range of from about 1200 to 1800 psig. Such low pressures have been found to promote the cracking of paraffinic hydrocarbons compared to the higher traditional pressure used in the first hydrocracking zone 7.

Another distinguishing characteristic of the subject process is the use of second stage makeup hydrogen for the process as the only hydrogen stream charged to the second stage hydrocracking zone. The ability to do this is related to the counterintuitive realization that a lower pressure is beneficial to paraffin conversion by hydrocracking in the second stage. This is derived from related paraffin hydrocracking research and is believed to result from a dehydrogenation step in the cracking mechanism. A typical fresh feed may contain from about 35to 50 vol. percent aromatic hydrocarbons depending on its source. The liquid recycle stream of a hydrocracking process will have a much lower aromatic content, with a total aromatic concentration of less than 10 percent being representative.

The makeup hydrogen charged to the process in line 21 is compressed in a first stage compressor 22 and passed through line 23 into the second stage or second compressor 24. Depending on the design of the compressor zone which encompasses these three compressor stage, line 23 may be internal to the compressor zone. The entire gas stream from the second stage is then preferably passed into the second hydrocracking reactor through line 25. This depiction assumes the makeup hydrogen of line 21 is delivered to the process at a pressure which dictates the use of three stages of compression. The delivery of the makeup hydrogen at a higher pressure results in a requirement for only one stage of compression prior to passage of the makeup gas into the second hydrocracking zone.

Because of this, and the benefits of the novel hydrogen flow, the capital and operating costs relating to gas compression are reduced. However, a much greater reduction in the capital cost of the process results from a lower operating pressure in the second stage, which reduces the cost of the process vessels and piping. The second hydrocracking zone is preferably operated at an inlet pressure less than about 1800 psig and at least 300 psi lower than the inlet pressure to the first hydrocracking zone, which includes any preliminary hydrotreating zone. Depending on several factors the second hydrocracking zone may be operated with an inlet pressure over 500 psig lower than the first hydrocracking zone. An additional advantage of the process results from the lower pressure employed in the second stage. This lower pressure has been found to increase paraffin conversion which normally improves product qualities as by reducing the pour point of recovered diesel boiling range hydrocarbons.

Hydrocarbons removed from the bottom of the product recovery column as a drag stream may be a high value product but are not considered to be either distillates or conversion products for purposes of this definition of conversion. The desired "distillate" products of a hydrocracking process are normally recovered as sidecuts of a product fractionation column and include the naphtha, kerosene and diesel fractions. The product distribution of the subject process is set by the feed composition and the selectivity of the catalyst(s) at the conversion rate obtained in the reaction zones at the chosen operating conditions. It is therefore subject to considerable variation. The subject process is especially useful in the production of middle distillate fractions boiling in the range of about 260–700° F. (127–371° C.) as determined by the appropriate ASTM test procedure.

The term "middle distillate" is intended to include the diesel, jet fuel and kerosene boiling range fractions. The terms "kerosene" and "jet fuel boiling point range" are intended to refer to about 260–550° F. (127–288° C.) and diesel boiling range is intended to refer to hydrocarbon boiling points of about 260–about 700° F. (127–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699 for further details on kerosene and diesel fuel properties and to D-1655 for aviation turbine feed. These definitions provide for the inherent variation in feeds and desired products which exists between different refineries. Typically, this definition will require the production of distillate hydrocarbons having boiling points below about 700° F. (371° C.).

While the hydrotreating zone is maintained at what are characterized as hydrotreating conditions and the hydrocracking zone is kept at hydrocracking conditions, these conditions may be somewhat similar. The pressure maintained in both the hydrotreating and hydrocracking reaction zones should be within the broad range of about 1000 to 2500 psia (6895–17,237 kPa). It is preferred to employ a pressure above 1500 psia (10,342 kPa) in the first hydrocracking zone. The reaction zones are operated with a hydrogen to hydrocarbon ratio of about 5,000 to 18,000 standard cubic feet of hydrogen per barrel of feedstock (843 to 3033 standard meter$^3$ per meter$^3$). Preferably this ratio is above 1100 standard meter$^3$ per meter$^3$ in both hydrocracking zones. Therefore, while the second hydrocracking zone is operated at a lower pressure it is not operated at mild hydrocracking conditions. The hydrotreating zone may be operated at an inlet temperature of about 450 to 670° F. (232–354° C.). The hydrocracking zones may be operated with an inlet temperature of 640–800° F. (338–427° C.). In the subject process the reaction zones are operated at conditions which include liquid hourly space velocities of from about 0.2 to 10 hr$^{-1}$, and preferably about 1.0 to about 2.5 hr$^{-1}$.

A preferred embodiment of the invention may be characterized as a two stage hydrocracking process which comprises compressing a first hydrogen makeup stream to an intermediate first pressure through at least the first stage of a makeup gas compressor train; passing a feed stream comprising hydrocarbons having boiling points above 700° F., a recycle hydrogen stream and a second makeup hydrogen stream into a hydrotreating reaction zone operated at hydrotreating conditions and producing a hydrotreating reaction zone effluent stream comprising hydrogen, hydrogen sulfide, and unconverted feed components having boiling points above about 700° F.; passing the hydrotreating reaction zone effluent stream into a first hydrocracking zone operated at hydrocracking conditions including a first pressure and containing a hydrocracking catalyst and producing a first hydrocracking zone effluent stream; separating the first hydrocracking zone effluent to yield a recycle gas stream and a first liquid process stream which is passed into a product fractionation zone producing a distillate product stream and a bottoms stream comprising unconverted feed components; passing the bottoms stream through an PNA adsorption zone and then, together with the first makeup hydrogen gas stream, into a second hydrocracking zone operated at paraffin selective hydrocracking conditions which include a lower second pressure, and producing a second hydrocracking zone effluent stream; separating the second hydrocracking effluent stream into a vapor phase stream and a liquid phase stream, and passing the liquid phase stream into the product fractionation zone; and compressing the vapor phase stream to a higher second pressure in the final stage of the makeup gas compressor train and then passing the vapor phase stream into the hydrotreating reaction zone as the second hydrogen makeup stream.

The subject process may employ two different types of catalyst, hydrotreating catalyst and hydrocracking catalyst. These two types of catalysts normally share many similarities. For instance, they may have relatively similar particle shape and size. Both normally comprise an inorganic support material and at least one hydrogenation metal. The two types of catalysts will, however, also differ significantly since each has been tailored to perform a different function. One of the most obvious differences is that the hydrocracking catalyst will also comprise one or more acidic cracking components, such as silica-alumina and/or Y-zeolite. Hydrotreating catalysts typically do not contain zeolitic materials or molecular sieve materials and often comprise only one or more metals on an amorphous alumina. The two types of catalysts are also expected to differ in other ways such as in terms of the metals employed as the hydrogenation component, the particle's pore volume distributions and density, etc. Suitable catalysts for use in the reaction zones of this process are available commercially from several vendors.

Both the hydrocracking and hydrotreating catalyst will typically comprise a base metal hydrogenation component chosen from nickel, cobalt, molybdenum and tungsten and possibly promoters such as phosphorous supported on an inorganic oxide catalyst. The hydrogenation metals are usually a Group VIB and/or a Group VIII metal component, with each base metal being present at a concentration based upon the finished catalyst equal to about to 2 to about 18 wt. % measured as the common metal oxide. A platinum group metal is preferably present at a lower concentration of about 0.1 to 1.5 wt. %. A preferred form of the catalyst is an extrudate having a symmetrical cross-sectional shape, which is preferably a cylindrical or polylobal shape. The cross-sectional diameter of the particles is usually from about 1/40 to about 1/8 inch and preferably about 1/32 to about 1/12 inch. A quadralobal cross-sectional shape resembling that of a four leaf clover is shown in U.S. Pat. No. 4,028,227. Other shapes which may be employed in the catalyst are described in this patent and in U.S. Pat. No. 4,510,261.

The preferred high activity hydrotreating catalyst comprises a hydrogenation component comprising nickel and molybdenum on an extruded porous support of phosphorous containing alumina. Details on the production of hydrotreating catalysts containing these four components are provided in U.S. Pat. Nos. 4,738,944; 4,818,743 and 5,389,595 which are incorporated herein for this teaching.

Both the hydrotreating and hydrocracking catalysts preferably comprise a support material which is highly porous, uniform in composition and relatively refractory to the conditions utilized in the hydrocarbon conversion process. The catalysts may comprise a variety of support materials which have traditionally been utilized in hydrocarbon conversion catalysts such as refractory inorganic oxides including alumina, titanium dioxide, zirconium dioxide, silica-alumina, silica-magnesia, silica-zirconia, silica or silica gel, clays, etc. The preferred support material for the hydrotreating catalyst is alumina.

The composition and physical characteristics of the catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of a fluidized or ebullated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The reaction zones therefore do not need to be fixed bed systems as depicted on the Drawing.

The catalyst particles may be prepared by any known method in the art including the well-known oil drop and extrusion methods. A preferred form for the catalysts used in the subject process is an extrudate.

A spherical catalyst for use in either the hydrotreating section or the hydrocracking section of the process may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

It is preferred that the hydrocracking catalyst comprises between 1 wt. % and 90 wt. % Y zeolite, preferably between about 5 wt. % and 80 wt. %. The zeolitic catalyst composition should also comprise a porous refractory inorganic oxide support (matrix) which may form between about 10 and 99 wt. %, and preferably between 20 and about 95 wt. % of the support of the finished catalyst composite. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. Preferably, the Y zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. It is contemplated that other zeolites, such as Beta, Omega, or ZSM-5, could be employed as the zeolitic component of the hydrocracking catalyst in place of or in addition to the preferred Y zeolite.

We claim as our invention:

1. A two stage hydrocracking process, which process comprises:

(a) passing hydrogen and a feed stream comprising hydrocarbons having boiling points above 700° F. into a first hydrocracking zone operated at hydrocracking conditions including a first pressure and containing a hydrocracking catalyst and producing a first hydrocracking zone effluent stream comprising hydrogen, hydrogen sulfide, unconverted feed components and product hydrocarbons;

(b) separating the first hydrocracking zone effluent to yield a recycle gas stream and a first liquid process stream, which liquid process stream is passed into a product fractionation zone producing a distillate product stream and a bottoms stream comprising unconverted feed components;

(c) passing the bottoms stream and a makeup hydrogen gas stream into a second hydrocracking zone operated at paraffin selective hydrocracking conditions which include a lower second pressure, and producing a second hydrocracking zone effluent stream;

(d) separating the second hydrocracking effluent stream into a vapor phase stream and a liquid phase stream, and passing the liquid phase stream into the product fractionation zone; and (e) compressing the vapor phase stream and passing the vapor phase stream into the first hydrocracking reaction zone as a makeup gas stream.

2. The process of claim 1 wherein the bottoms stream is passed through a Polynuclear aromatic (PNA) adsorption zone before being passed into the second hydrocracking zone.

3. The process of claim 2 wherein the second hydrocracking zone is operated at an inlet pressure at least 300 psi lower than the first hydrocracking zone.

4. A two stage hydrocracking process, which process comprises:

(a) compressing a first hydrogen makeup stream to an intermediate first pressure;

(b) passing a feed stream comprising hydrocarbons having boiling points above 700° F., a recycle hydrogen stream and a second makeup hydrogen stream into a hydrotreating reaction zone operated at hydrotreating conditions and producing a hydrotreating reaction zone effluent stream comprising hydrogen, hydrogen sulfide, and unconverted feed components having boiling points above about 700° F.;

(c) passing the hydrotreating reaction zone effluent stream into a first hydrocracking zone operated at hydrocracking conditions including a first pressure and containing a hydrocracking catalyst and producing a first hydrocracking zone effluent stream comprising hydrogen, product hydrocarbons and unconverted hydrocarbons;

(d) separating the first hydrocracking zone effluent to yield a recycle gas stream and a first liquid process stream which is passed into a product fractionation zone producing a distillate product stream and a bottoms stream comprising unconverted feed components;

(e) passing the bottoms stream and the first make up hydrogen gas stream into a second hydrocracking zone operated at paraffin selective hydrocracking conditions which include a lower second pressure, and producing a second hydrocracking zone effluent stream;

(f) separating the second hydrocracking effluent stream into a vapor phase stream and a liquid phase stream, and passing the liquid phase stream into the product fractionation zone; and (g) compressing the vapor phase stream to a higher second pressure and passing the vapor phase stream into the hydrotreating reaction zone as the second hydrogen makeup stream.

5. The process of claim 4 wherein the bottoms stream is passed through a Polynuclear aromatic (PNA) adsorption zone before being passed into the second hydrocracking zone.

6. The process of claim 5 wherein the second hydrocracking zone is operated at an inlet pressure less than 1850 psig and at least 300 psi lower than the first hydrocracking zone.

7. A two stage hydrocracking process, which process comprises:

(a) compressing a first hydrogen makeup stream to an intermediate first pressure through at least the first stage of a makeup gas compressor train;

(b) passing a feed stream comprising hydrocarbons having boiling points above 700° F., a recycle hydrogen stream and a second makeup hydrogen stream into a hydrotreating reaction zone operated at hydrotreating conditions and producing a hydrotreating reaction zone effluent stream comprising hydrogen, hydrogen sulfide, and unconverted feed components having boiling points above about 700° F.;

(c) passing the hydrotreating reaction zone effluent stream into a first hydrocracking zone operated at hydrocracking conditions including a first pressure and containing a hydrocracking catalyst and producing a first hydrocracking zone effluent stream;

(d) separating the first hydrocracking zone effluent to yield a recycle gas stream and a first liquid process stream which is passed into a product fractionation zone producing a distillate product stream and a bottoms stream comprising unconverted feed components;

(e) passing the bottoms stream through a Polynuclear aromatic (PNA) adsorption zone and then, together with the firseup hydrogen gas stream, into a second hydrocracking zone operated at paraffin selective hydrocracking conditions which include a lower second pressure, and producing a second hydrocracking zone effluent stream;

(f) separating the second hydrocracking effluent stream into a vapor phase stream and a liquid phase stream, and passing the liquid phase stream into the product fractionation zone; and (g) compressing the vapor phase stream to a higher second pressure in the final stage of the makeup gas compressor train and then passing the vapor phase stream into the hydrotreating reaction zone as the second hydrogen makeup stream.

8. The process of claim 7 wherein the entire vapor phase stream recovered from the second hydrocracking effluent stream is passed into the hydrotreating reaction zone.

* * * * *